US008774667B2

(12) United States Patent
Mukai et al.

(10) Patent No.: US 8,774,667 B2
(45) Date of Patent: Jul. 8, 2014

(54) IMAGE FORMING APPARATUS

(75) Inventors: Takashi Mukai, Osaka (JP); Toshiaki Kagawa, Osaka (JP); Hiroyuki Yamaji, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 656 days.

(21) Appl. No.: 13/051,033

(22) Filed: Mar. 18, 2011

(65) Prior Publication Data

US 2011/0236048 A1 Sep. 29, 2011

(30) Foreign Application Priority Data

Mar. 25, 2010 (JP) ..... 2010-070865

(51) Int. Cl.
*G03G 15/20* (2006.01)

(52) U.S. Cl.
USPC ..... 399/70; 399/67; 399/69; 399/88

(58) Field of Classification Search
USPC ..... 399/67, 69, 70, 88
See application file for complete search history.

(56) References Cited

U.S. PATENT DOCUMENTS

| | | | | |
|---|---|---|---|---|
| 5,521,686 | A * | 5/1996 | Muto | 399/69 |
| 6,952,541 | B2 | 10/2005 | Fujimori et al. | |
| 2007/0036570 | A1 | 2/2007 | Tatematsu et al. | |
| 2009/0169232 | A1 | 7/2009 | Kunii et al. | |

FOREIGN PATENT DOCUMENTS

| | | | |
|---|---|---|---|
| JP | 06-202525 | A | 7/1994 |
| JP | 2000-098796 | A | 4/2000 |
| JP | 2000-267496 | | 9/2000 |
| JP | 2004-126191 | A | 4/2004 |
| JP | 2004-233745 | A | 8/2004 |
| JP | 2005-345989 | A | 12/2005 |
| JP | 2006-119194 | A | 5/2006 |

* cited by examiner

*Primary Examiner* — Walter L Lindsay, Jr.
*Assistant Examiner* — Ruth LaBombard
(74) *Attorney, Agent, or Firm* — Renner, Otto, Boisselle & Sklar, LLP

(57) ABSTRACT

An image forming apparatus is provided. The image forming apparatus includes an image forming section, an intermediate transfer section, a secondary transfer section, a fixing section, a power source, a voltage detection section, a temperature detection section, and a fixing section control circuit. The fixing section control circuit includes a switching control section, a voltage judgment section, a temperature judgment section, and a preparation control section. When the switching control section switches the current conduction state to the heat source and the driving section from an off conduction state to an on conduction state and the voltage judgment section judges to be less than a threshold voltage, the preparation control section controls the preparation operation of the heating section such that the switching control section continues the on conduction state over a given idle time after the temperature judgment section has judged to be a preset temperature or higher.

3 Claims, 11 Drawing Sheets

IMAGE FORMING APPARATUS

CROSS-REFERENCE TO RELATED APPLICATION

This application claims priority to Japanese Patent Application No. 2010-070865, which was filed on Mar. 25, 2010, the contents of which are incorporated herein by reference in its entirety.

BACKGROUND OF THE INVENTION

1. Field of the Invention

The present invention relates to an image forming apparatus.

2. Description of the Related Art

An electrophotographic image forming apparatus widely employed in a copying machine, a laser printer, a facsimile and the like is equipped with a fixing device of a heat fixing system. The fixing device of a heat fixing system comprises a fixing roller and a pressure roller. The fixing roller and the pressure roller each comprise a core metal comprising a metal or the like, and an elastomer layer comprising a resin or a rubber, having excellent releasability, formed on a surface of the core metal. A heater as a heat source is provided inside the fixing roller, and the heater heats the fixing roll and the pressure roller so as to reach a given temperature by application of heat generated by the heater. In the fixing device of a heat fixing system, the fixing roller and the pressure roller are heated to a given temperature, and the heated fixing roller and pressure roller are then press-contacted with each other. As a result, when a recording medium having an unfixed toner image borne thereon passes through a fixing nip region formed between those rollers, those rollers fuse a toner constituting the unfixed toner image by application of heat, thereby fixing the unfixed toner image to the recording medium. The fixing device of a heat fixing system holds the whole of the fixing roller and the pressure roller at a given temperature, and is therefore suitable for high speed printing.

However, the fixing device of a heat fixing system is required to heat the fixing roller and the pressure roller to a given temperature by a heater provided inside the fixing roller at the time of power activation of an image forming apparatus, and this relatively increases the time of from the power activation to a printable state (warming-up time). For this reason, there is the problem that the time of from power activation by a user to output of a recording medium having an image printed thereon becomes long.

A method for shortening a warming-up time includes a method of decreasing heat capacity of a fixing roller by, for example, decreasing a thickness of a core metal of the fixing roller. A method of shortening the time until a recording medium having an image printed thereon is outputted includes a method of initiating a paper-passing operation at a fraction of the time after reaching a surface temperature of the fixing roller to a given fixable temperature.

However, the fixing device equipped with a fixing roller having small heat capacity involves the case that storage of heat of the fixing roller is not sufficient just after completion of the warming-up. In such a case, heat on the surface of the fixing roller is absorbed by the recording medium passing through the fixing nip region at the time of fixing operation, and the surface temperature of the fixing roller cannot be maintained at a given fixable temperature, leading to occurrence of poor fixing.

To achieve energy saving by reducing consumed power as much as possible, the time until moving from a standby mode (ready state) that performs heat retention of the fixing roller during stopping job to a sleep mode that does not perform heat retention of the fixing roller tends to be shortened. For this reason, in some cases, storage of heat of the fixing roller may be not sufficient just after completion of sleep return operation that returns to a job operable state from a sleep mode. Even in such as case, poor fixing occurs similarly as described before.

To overcome the problem, Japanese Unexamined Patent Publication JP-A 2004-126191 discloses an image forming apparatus in which storage of heat of a fixing roller is estimated and idle time of the fixing roller is changed after completion of warming-up according to the estimated storage of heat.

According to the image forming apparatus disclosed in JP-A 2004-126191, the period until completion of warming-up operation from power activation is measured, and storage of heat of the fixing roller is estimated based on the measurement result.

Japanese Unexamined Patent Publication JP-A 2006-119194 discloses an image forming apparatus in which time interval of conveying a recording medium to a fixing roller is prolonged or conveying speed of a recording medium is decreased. According to the image forming apparatus disclosed in JP-A 2006-119194, lowering of a surface temperature of a fixing roller is suppressed by reducing a quantity of heat absorbed in a recording medium from the fixing roller per unit time, thereby fixability can be improved.

In an image forming apparatus, when an external power source is a power source such as a private power generator or electric power is supplied to the image forming apparatus in a form of multiple connection (octopus wiring) together with other OA (Office Automation) equipment, power supply to the image forming apparatus becomes unstable state. Alternatively, impedance of a power supply line becomes large, resulting in the state that voltage varies by the variation of electric current. Furthermore, commercial alternating current source has relatively large variation to rated voltage, depending on power supply circumstance of each country.

When variation of voltage applied to an image forming apparatus is large and low voltage is applied to a heater provided inside a fixing roller, current conduction to the heater is insufficient, and quantity of heat supplied to a core metal of a fixing roller from the heater lacks.

For example, in the image forming apparatus disclosed in JP-A 2004-126192, when voltage applied is lower than rated voltage and current conduction to a heater is initiated, not in the state that applied voltage is lower than rated voltage and a surface temperature of a fixing roller is not sufficiently decreased to room temperature, but in the state that the fixing roller has a heated surface, because the surface temperature of the fixing roller is already high, the measurement time until completion of warming-up operation is short even though the applied voltage is lower than rated voltage. In this case, with respect to the image forming apparatus, storage of heat of the fixing roller is estimated using the measurement time until completion of the warming-up operation, and it is therefore judged that the fixing roller sufficiently stores heat. When job is started in this state, because voltage lower than rated voltage is applied to the heater, the heat storage of the fixing roller is not sufficient, and this may lead to occurrence of poor fixing.

In the image forming apparatus disclosed in JP-A 2006-119194, time interval of conveying a recording medium to a fixing nip region is prolonged or conveying speed of a recording medium is decreased. Therefore, printing speed is decreased, and high speed printing cannot be realized.

SUMMARY OF THE INVENTION

An object of the invention is to provide an image forming apparatus equipped with a fixing device of a heat fixing system, in which even though power supply is an unstable state, storage of heat of a fixing section can sufficiently be secured before initiation of an image forming operation, thereby occurrence of poor fixing can be prevented and additionally high speed printing can be realized.

The invention provides an image forming apparatus in which a toner image is formed by feeding a toner to an electrostatic latent image formed on an image bearing member by electrophotography, by a developing device, the apparatus comprising:

a transfer section which transfers the toner image borne on the image bearing member to a recording medium;

a fixing section which heats the image toner transferred to the recording medium to fix the image toner to the recording medium, the fixing section comprising a heating section having a heat source for generating heat by current conduction provided therein, and arranged so as to be rotation-driven around an axis thereof, a pressure section provided so as to form a pressure-contact part between the pressure section and the heating section by coming into pressure-contact with the heating section, and a driving section which rotates the heating section by current conduction;

a power source which applies a voltage to the fixing section;

a voltage detection section which detects a voltage applied to the fixing section from the power source;

a temperature detection section which detects a temperature of a surface of the heating section; and a fixing control section which controls the operation of the fixing section, the fixing control section comprising:

a switching control section which controls switching on and off conduction operations between the heat source and the power source, and between the driving section and the power source;

a voltage judgment section which judges as to whether or not a detected voltage by the voltage detection section is a given threshold voltage or more;

a temperature judgment section which judges as to whether or not a detected temperature by the temperature detection section is a given preset temperature or higher; and a preparation control section which controls a preparation operation of the heating section before performing the operation of forming a toner image on the image carrier, wherein when the switching control section switches a conduction state to the heat source and the driving section from an off conduction state to an on conduction state and the voltage judgment section judges that the detected voltage by the voltage detection section is less than the threshold voltage, the preparation control section controls the preparation operation of the heating section such that the switching control section continues the on conduction state over a given idle time after the temperature judgment section has judged that the detected temperature by the temperature detection section is a preset temperature or higher.

According to the invention, the image forming apparatus comprises the transfer section, the fixing section, the power source, the voltage detection section, the temperature detection section and the fixing control section. The fixing control section comprises the switching control section, the voltage judgment section, the temperature judgment section and the preparation control section. The preparation control section controls the preparation operation of the heating section before performing the operation of forming a toner image of an image carrier. When the switching control section switches a conduction state to the heat source and the driving section from an off conduction state to an on conduction state and the voltage judgment section judges that the detected voltage by the voltage detection section is less than the threshold voltage, the preparation control section controls the preparation operation of the heating section such that the switching control section continues the on conduction state to the heat source and the driving section over a given idle time after the temperature judgment section has judged that the detected temperature by the temperature detection section is a given preset temperature or higher.

When the voltage judgment section judges that the detected voltage by the voltage detection section is less than the threshold voltage, the preparation control section controls the preparation operation of the heating section such that the switching control section continues the on conduction state to the heat source and the driving section over a given idle time. Therefore, even though voltage applied to the fixing section is low and current conduction to the heating section is insufficient, storage of heat of the heating section can sufficiently be secured before performing image forming operation by an image creating section, that is, before initiation of image forming operation, and as a result, occurrence of poor fixing can be prevented. Furthermore, because storage of heat of the heating section is sufficiently secured, even though a large amount of a recording medium is continuously conveyed to a pressure-contact part at the time of fixing and heat of the heating section is absorbed by the recording medium, lowering of the temperature of the heating section can be suppressed by utilizing the heat storage. As a result, time interval that the recording medium is conveyed to the pressure-contact part can be shortened or conveying speed of the recording medium can be increased, thereby high speed printing can be realized.

Furthermore, it is preferable that when voltage is applied to the fixing section from the power source or when return operation from a sleep mode is initiated, the preparation control section controls the preparation operation of the heating section.

According to the invention, when voltage is applied to the fixing section from the power source or when return operation from a sleep mode is initiated, the preparation control section controls the preparation operation of the heating section. Just after voltage has been applied to the fixing section from the power source or just after the return operation from a sleep mode has been initiated, the surface temperature of the heating section is lower than the fixable temperature. This requires that the temperature of the heating section must be higher than the preset temperature before performing the image forming operation. In such a case, when low voltage is applied to the fixing section, current conduction to the heat source becomes insufficient, and quantity of heat supplied to the heating section from the heat source is insufficient.

When voltage is applied to the fixing section from the power source or when return operation from a sleep mode is initiated, the preparation control section controls the preparation operation of the heating section. This control makes it possible to sufficiently secure storage of heat of the heating section before initiating the image forming operation, can prevent occurrence of poor fixing, and additionally can realize high speed printing.

Furthermore, it is preferable that the image forming apparatus comprises a memory section which memorizes a first table linking the idle time and a voltage value, and the preparation control section determines the idle time using the first table.

According to the invention, the image forming apparatus comprises a memory section which memorizes a first table linking the idle time and a voltage value, and the preparation control section determines the idle time using the first table. By this embodiment, the preparation control section can determine the idle time according to the voltage applied to the fixing section.

Furthermore, it is preferable that the image forming apparatus comprises a reserved job number detection section which detects a number of reserved jobs corresponding to a reserved number of sheets of recording mediums on which an image is formed, the memory section memorizes a second table linking the idle time, the number of reserved jobs and a voltage value, and the preparation control section determines the idle time using the second table.

According to the invention, the image forming apparatus comprises the reserved job number detection section which detects the number of reserved jobs corresponding to the reserved number of sheets of recording mediums on which an image is formed. The memory section memorizes a second table linking the idle time, the number of reserved jobs and a voltage value, and the preparation control section determines the idle time using the second table. By this embodiment, the preparation control section can determine the idle time in response to the voltage applied to the fixing section from the powder source and the number of reserved jobs.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
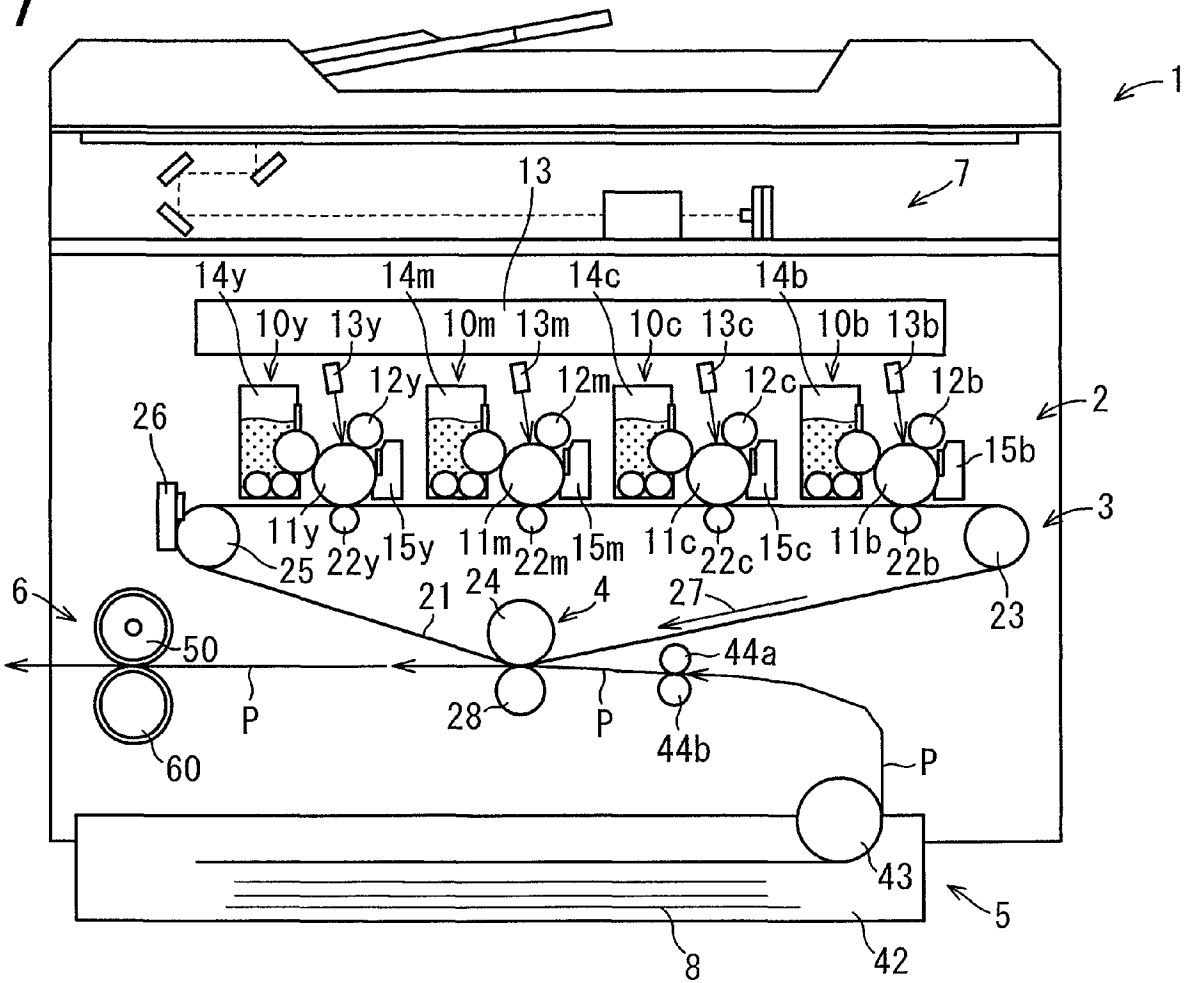
FIG. 1 is a view schematically showing the constitution of an image forming apparatus according to one embodiment of the invention.

Now referring to the drawings, preferred embodiments of the invention are described below.

FIG. 1 is a view schematically showing the constitution of an image forming apparatus 1 according to one embodiment of the invention. The image forming apparatus 1 comprises an image forming section 2, an intermediate transfer section 3, a secondary transfer section 4, a recording medium feeding section 5, and a fixing section 6. The image forming apparatus 1 further comprises a display section, an operation section and a control section, which are not shown in FIG. 1.

(Image Forming Section)

The image forming section 2 which is an image creating section comprises image forming units 10*y*, 10*m*, 10*c* and 10*b*. The image forming units 10*y*, 10*m*, 10*c* and 10*b* form an electrostatic latent image corresponding to a digital signal of each color (hereinafter referred to as "image information"), develop the electrostatic latent image, and form a toner image by a toner of each color. Specifically, the image forming unit 10*y* forms a toner image corresponding to the image information of yellow color, the image forming unit 10*m* forms a toner image corresponding to the image information of magenta color, the image forming unit 10*c* forms a toner image corresponding to the image information of cyan color, and the image forming unit 10*b* forms a toner image corresponding to the image information of black color.

As the image forming units 10*y*, 10*m*, 10*c*, and 10*b* are of the same configuration except that a yellow developer, magenta developer, cyan developer, and black developer are used in the respective image forming units, and that, among pieces of image information inputted into the image forming section 2, a pixel signal corresponding to a yellow component image, a pixel signal corresponding to a magenta component image, a pixel signal corresponding to a cyan component image, and a pixel signal corresponding to a black component image are inputted into the respective image forming units, hereafter, the image forming unit 10*y* for yellow will be shown as a representative example, and a description of the others will be omitted.

The image forming units 10 and the like for the individual colors, when separately shown, will be represented with alphabetical suffixes: y (yellow), m (magenta), c (cyan), and b (black), affixed thereto. The image forming units 10*y*, 10*m*, 10*c*, and 10*b* are arranged side by side in the order named, from an upstream side to a downstream side, in a direction of movement (a sub-scanning direction) of an intermediate transfer belt 21, that is, in the direction of an arrow 27.

Figure 2:
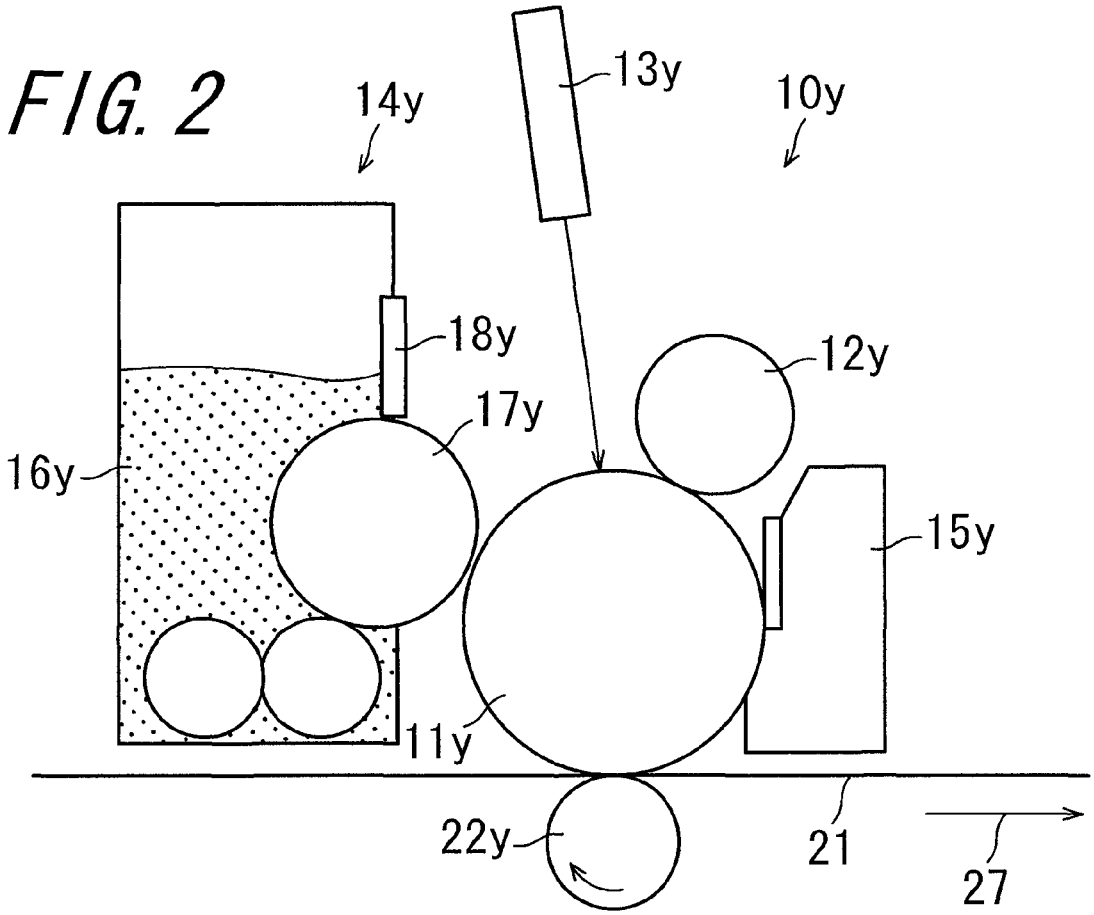
FIG. 2 is a view schematically showing the constitution of an image forming unit.

FIG. 2 is a view schematically showing the constitution of the image forming unit 10*y*. The image forming unit 10*y* comprises a photoreceptor drum 11*y*, a charging roller 12*y*, a light scanning unit 13*y*, a developing device 14*y* and a drum cleaner 15*y*.

The photoreceptor drum 11*y* is an image bearing member on the surface of which a toner image of yellow color is to be formed, is supported so as to be rotation-driven around an axis thereof, and comprises cylindrical, columnar or thin film sheet-shaped (preferably, cylindrical) conductive substrate and a photosensitive layer formed on the surface of the conductive layer, which are not shown.

The photoreceptor drum 11*y* can use any photoreceptor drums conventionally used in this field, and can use, for example, a photoreceptor drum connected to GND (ground) potential, comprising an aluminum pipe stock as a conductive substrate and an organic photosensitive layer which is a photosensitive layer formed on the surface of the aluminum pipe stock.

The organic photosensitive layer may be one formed laminating a charge generating layer including a charge generating substance, and a charge transporting layer including a charge transporting substance, or may be one having the charge generating substance and charge transporting substance included in one layer. The thickness of the organic photosensitive layer is not particularly limited but is, for example, 20 μm. Also, an undercoat layer between the organic layer and conductive substrate may be provided. Furthermore, a protecting layer may be provided on the surface of the organic photosensitive layer.

The photoreceptor drum 11*y* rotates at a peripheral speed of, for example, 220 mm/sec in a counterclockwise direction to the paper of FIG. 2 by a driving section which is not shown in FIG. 2. The driving section of the photoreceptor drum 11*y* is controlled by an image forming section control section described hereinafter, and rotation speed of the photoreceptor drum 11*y* is controlled by the image forming section control section.

The charging roller 12*y* is a charging section which charges the surface of the photoreceptor drum 11*y* with potential of predetermined polarity. As the charging section, it is not limited to only the charging roller 12*y* and the charging roller 12*y* can be replaced by a brush-type charging device, a charger-type charging device, or a corona charging device such as a scorotron charger.

The light scanning unit 13*y* is a latent image forming section which irradiates the charged surface of the photoreceptor drum 11*y* with a laser beam corresponding to the yellow image information, and forms an electrostatic latent image corresponding to the yellow image information on the surface of the photoreceptor drum 11*y*. A semiconductor laser element or the like is used as a laser beam light source.

The developing device 14*y* is provided facing the photoreceptor drum 11*y*, and is a developing section in which of a yellow toner and a carrier that are contained in a two-component developer 16*y*, the yellow toner is borne on a surface of a developing sleeve 17*y*, the toner is regulated to a thickness of a given amount by a layer thickness regulating member 18*y* and conveyed to the surface of the photoreceptor drum 11*y*, and an electrostatic latent image formed on the surface of the photoreceptor drum 11*y* is developed to visualize the latent image. A developer can use a one-component developer free of a carrier.

The developing sleeve 17*y* is rotation-driven in the same direction as a direction of rotational drive of the photoreceptor drum 11*y*, in a developing nip region which is close to the photoreceptor drum 11*y*.

The drum cleaner 15*y* has the function that after a toner image of yellow color on the surface of the photoreceptor drum 11*y* is intermediately transferred to an intermediate transfer belt 21, the residual yellow toner on the surface of the photoreceptor drum 11*y*, which is not intermediately transferred to the intermediate transfer belt 21 is removed and collected.

According to the image forming unit 10*y*, for example, 1200 V is applied to the charging roller 12*y* by a power source (not shown) while rotationally driving the photoreceptor drum 11*y* around its axis, and the photoreceptor drum 11*y* is discharged, thereby charging the surface of the photoreceptor drum 11*y* to, for example, 600 V. Next, the charged surface of the photoreceptor drum 11*y* is irradiated with the laser beam corresponding to the yellow image information from the light scanning unit 13*y*, forming an electrostatic latent image with an exposure potential of −70 V corresponding to the yellow image information.

The surface of the photoreceptor drum 11*y* and the yellow toner borne on the surface of the development sleeve 17 are close to each other. Direct current voltage of −450V is applied as development potential to the developing sleeve 17*y*, the yellow toner is adhered to the electrostatic latent image by voltage difference between the developing sleeve 17*y* and the photoreceptor drum 11*y*, and an yellow toner image is formed on the surface of the photoreceptor drum 11*y*. The yellow toner image is intermediately transferred to the intermediate transfer belt 21 which comes into pressure-contact with the surface of the photoreceptor drum 11*y* and is driven in a direction of an arrow 27, as described hereinafter. The residual yellow toner on the surface of the photoreceptor drum 11*y* is removed and collected by the drum cleaner 15*y*. Formation operation of the yellow toner image is repeatedly performed in the same manner as above.

Two-component developers 16*y*, 16*m*, 16*c* and 16*b* used in the image forming apparatus 1 of the present embodiment are described in detail below. The two-component developers 16*y*, 16*m*, 16*c* and 16*b* comprise a toner and a carrier.

The toner comprises toner particles each containing a binder resin, a colorant, and a release agent. As the binder resin, ingredients customarily used in this field can be used, and examples thereof include polystyrene, a homopolymer of styrene substitute, a styrene-type copolymer, polyvinyl chloride, polyvinyl acetate, polyethylene, polypropylene, polyester, and polyurethane. The binder resins may be used each alone, or two or more thereof may be used in combination.

Among the above kinds of binder resin, for the color toner, preferable is the binder resin which has a softening temperature of 100° C. to 150° C. and a glass transition temperature of 50° C. to 80° C., and particularly preferable is polyester which has a softening temperature and a glass transition temperature in the above ranges, from the aspect of storage stability, durability, etc. Polyester in a softened or fused state is high in transparency. In the case where polyester is used as the binder resin, when a multicolor toner image composed of overlaid toner images of yellow, magenta, cyan, and black, is fixed on a recording sheet 8 by the fixing section 6 described hereinafter, the polyester itself becomes transparent, leading to sufficient color development by subtractive color mixture.

As the colorant, it is possible to use pigments and dyes for toner which have been conventionally used in the electrophotographic image forming technique. Examples of the pigment include an organic pigment such as azo pigment, benzimidazolone pigment, quinacridone pigment, phthalocyanine pigment, isoindolinone pigment, isoindoline pigment, dioxazine pigment, anthraquinone pigment, perylene pigment, perynone pigment, thioindigo pigment, quinophthalone pigment, or metal complex pigment; an inorganic pigment such as carbon black, titanium oxide, molybdenum red, chrome yellow, titanium yellow, chrome oxide, or Berlin blue; and metal powder such as aluminum powder. The pigments may be used each alone, or two or more thereof may be used in combination.

As the release agent, wax can be used, for example. It is possible to use the wax which is customarily used in this field, and examples thereof include polyethylene wax, polypropylene wax, and paraffin wax.

The toner may contain, other than the binder resin, colorant, and release agent, one or two or more additives for general use in toner, such as a charge control agent, a fluidity improving agent, a fixing promoting agent, and a conductive agent.

The toner can be produced by the conventional methods such as a pulverization method, a suspension polymerization method or an emulsion coagulation method. The pulverization method obtains a toner by melt-kneading a colorant, a release agent and the like with a binder resin, and pulverizing the melt-kneaded product. The suspension polymerization method obtains a toner by uniformly dispersing monomers such as a binder resin, a colorant and a release agent, and polymerizing those monomers. The emulsion coagulation method obtains a toner by coagulating a binder resin, a colorant and a release agent by a coagulating agent, and heating fine particles of the aggregates obtained.

A volume average particle size of the toner is not particularly limited, but is preferably from 2 μm to 7 μm. When the volume average particle size of the toner is appropriately small as above, coverage of the toner to a recording medium 8 is increased. This makes it possible to achieve high image quality with a small amount of the toner adhered and reduction in the amount of the toner consumed.

When the volume average particle size of the toner is less than 2 μm, fluidity of the toner is decreased, and feeding, stirring and charging of the toner become insufficient during the development operation. This leads to insufficient amount of a toner fed to the photoreceptor drum 11 and increase in amount of a toner having reverse polarity, and a high quality image may not be obtained. When the volume average particle size of the toner exceeds 7 μm, toner particles having a large particle size which are difficult to be softened up to the central portion at the time of fixing are increased. As a result, fixability of a toner image to the recording medium 8 is deteriorated, and additionally, coloration of an image is deteriorated. Particularly, in the case of fixing to an OHP sheet, an image becomes murky.

The toner used in the image forming apparatus 1 of the present embodiment is a negatively charging insulating non-magnetic toner having a glass transition temperature of 60° C., a softening temperature of 120° C., and a volume average particle size of 6 μm. To obtain an image density having a reflection density measurement value by 310 manufactured by X-Rite of 1.4 using this toner, the toner is required in an amount of 5 g/m$^2$ on the surface of the recording medium 8.

The toner comprises a polyester having a glass transition temperature of 60° C. and a softening temperature of 120° C. as a binder resin, a pigment of each color as a colorant in an amount of 12% by weight based on the total amount of the toner, and a low molecular polyethylene wax having a glass transition point of 50° C. and a softening point of 70° C. as a release agent in an amount of 7% by weight based on the total amount of the toner. The low molecular polyethylene wax used as a release agent in this toner is a wax having a glass transition temperature and a softening temperature lower than those of the polyester used as a binder resin.

The carrier can use magnetic particles. Examples of the magnetic particles include metals such as iron, ferrite and magnetite, and alloys of those metals and metals such as aluminum and lead. Of those, ferrite is preferred.

A resin-coated carrier comprising magnetic particles having a resin applied on the surface thereof, or a resin-dispersed carrier comprising a resin and magnetic particles dispersed therein may be used as the carrier. Resins for covering the magnetic particles are not particularly limited. Examples of the resin include an olefinic resin, a styrenic resin, a styrene-acryl resin, a silicone resin, an ester resin and a fluorine-containing polymer resin. The resin used in the resin-dispersed carrier is not particularly limited. Examples the resin include a styrene-acryl resin, a polyester resin, a fluorine resin and a phenolic resin.

A volume average particle size of the carrier is not particularly limited. Considering high image quality, the volume average particle size is preferably from 30 μm to 50 μm. The resistivity of the carrier is preferably $10^8$ Ω·cm or more, and more preferably $10^{12}$ Ω·cm or more.

The volume resistivity of the carrier is a value obtained from a current value determined as follows. The carrier particles are put into a container having a cross-sectional area of 0.50 cm$^2$, and then tapped. Subsequently, a load of 1 kg/cm$^2$ is applied by use of a weight to the particles which are held in the container. When an electric field of 1000 V/cm is generated between the load weight and a bottom electrode of the container by application of voltage, a current value is read. When the resistivity of the carrier is low, an electric charge will be injected into the carrier upon application of bias voltage to a developing sleeve 17*y*, thus causing the carrier particles to be more easily attached to the photoreceptor drum 11*y*. Further, breakdown of the bias voltage is more liable to occur.

The magnetization intensity (maximum magnetization) of the carrier is preferably 10 emu/g to 60 emu/g, and more preferably, 15 emu/g to 40 emu/g. Although the magnetization intensity depends on the magnetic flux density of the developing sleeve 17*y*, under conditions of the general magnetic flux density of the developing sleeve 17*y*, there is a fear that no magnetic constraint force acts in the event of less than 10 emu/g, causing a carrier dispersion. Also, when the magnetization intensity exceeds 60 emu/g, with a non-contact development in which a magnetic brush of the carrier is too high, it is difficult to keep a non-contact condition with the photoreceptor drum 11*y*. Also, with a contact development, there is a fear that a brush mark is likely to appear in the toner image.

It is preferable that the shape of the carrier is a spherical or flat shape.

A blend ratio of toner and carrier in the developers 16*y*, 16*m*, 16*c*, and 16*b* is not particularly limited, and it is sufficient to appropriately select it depending on the type of toner and carrier.

(Intermediate Transfer Section)

As shown in FIG. 1, the intermediate transfer section 3 comprises an intermediate transfer belt 21, intermediate transfer rollers 22*y*, 22*m*, 22*c* and 22*b*, supporting rollers 23 and 25, and a belt cleaner 26. In the present embodiment, the transfer section is constituted of the intermediate transfer section 3 and a secondary transfer section 4 described hereinafter.

The intermediate transfer belt 21 is an endless belt-shaped image bearing member which is supported around the supporting rollers 23 and 25 and a supporting roller 24 described hereinafter with tension and forms a loop-shaped movement passage, and is rotation-driven in a direction of the arrow 27, that is, such that an image bearing surface facing the photoreceptor drums 11*y*, 11*m*, 11*c* and 11*b* moves toward the photoreceptor drum 11*b* from the photoreceptor 11*y*, in substantially the same peripheral speed as the photoreceptor drums 11*y*, 11*m*, 11*c* and 11*b*.

As the intermediate transfer belt 21, it is possible to use, for example, a polyimide film having thickness of 100 μm. As a material of the intermediate transfer belt 21, it not being limited to polyimide, it is possible to use a film configured of a synthetic resin, such as polycarbonate, polyamide, polyester, or polypropylene, various kinds of rubber, or the like.

The film made of a synthetic resin or any kind of rubber contains an electrically conductive material, such as furnace black, thermal black, channel black, or graphite carbon, in order to adjust an electric resistance value with which it acts as the intermediate transfer belt 21. Also, a covering layer configured of a fluorine resin composition, fluorine-containing rubber, or the like, which has a low adhesion to toner, may be provided on the intermediate transfer belt 21. As a component material of the covering layer, examples thereof include polytetrafluoroethylene (PTFE) and PFA (a copolymer of PTFE and perfluoroalkyl vinyl ether). The covering layer may contain an electrically conductive material.

An image bearing surface of the intermediate transfer belt 21 comes into pressure-contact with the photoreceptor drums 11*y*, 11*m*, 11*c*, and 11*b* in the order just stated from the upstream side in the rotational direction of the intermediate transfer belt 21. Positions where the intermediate transfer belt 21 comes into pressure-contact with the photoreceptor drums

11*y*, 11*m*, 11*c*, and 11*b*, are positions where toner images of respective colors are transferred.

The intermediate transfer rollers 22*y*, 22*m*, 22*c*, and 22*b* are roller members which are respectively opposed to the photoreceptor drums 11*y*, 11*m*, 11*c*, and 11*b* with the intermediate transfer belt 21 interposed therebetween and come into pressure-contact with a reverse side of the image bearing surface 21*a* of the intermediate transfer belt 21 and which are disposed so as to be rotation-driven about respective axes of the rollers by a driving section (not shown).

For each of the intermediate transfer rollers 22*y*, 22*m*, 22*c*, and 22*b*, a roller member is used, for example, which is composed of a metal shaft and a conductive layer covering a surface of the metal shaft.

The metal shaft is, for example, formed of a metal such as stainless steel. A diameter of the metal shaft is not particularly limited, and preferably from 8 mm to 10 mm.

The conductive layer is formed of a conductive elastic body or the like material. As the conductive elastic body, a material customarily used in this field is applicable, and examples thereof include ethylene-propylene rubber (hereinafter described as EPDM), foamed EPDM, and urethane foam, which contain a conductive material such as carbon black. Owing to the conductive layer, high voltage is evenly applied to the intermediate transfer belt 21.

Owing to the conductive layer, high voltage is evenly applied to the intermediate transfer belt 21.

Since the toner images formed on the surfaces of the photoreceptor drum 11*y*, 11*m*, 11*c*, and 11*b* are transferred onto the intermediate transfer belt 21, intermediate transfer bias voltage is applied to the intermediate transfer rollers 22*y*, 22*m*, 22*c*, and 22*b* through a constant voltage control, which bias has a polarity reverse to that of the polarity of the charged toner. By so doing, the toner images of yellow, magenta, cyan, and black formed on the photoreceptor drums 11*y*, 11*m*, 11*c*, and 11*b* are sequentially transferred and overlaid on top of one another on the image bearing surface of the intermediate transfer belt 21, thus forming a multicolor toner image. Note that in the case where image information of only part of yellow, magenta, cyan, and black is inputted, a toner image is formed by only an image forming unit 10 corresponding to a color of inputted image information, among the image forming units 10*y*, 10*m*, 10*c*, and 10*b*.

Among the supporting rollers 23, 24, and 25, the supporting rollers 23, and 25 are disposed so as to be rotation-driven about respective axes thereof by a driving section (not shown), support the intermediate transfer belt 21 therearound with tension and rotated in the direction of the arrow 27 by the supporting rollers 23, 24, and 25. For each of the supporting rollers 23, 24, and 25, an aluminum-made cylinder (a pipe-shaped roller) is used, for example, having a diameter of 30 mm and a thickness of 1 mm. The supporting roller 24 comes into pressure-contact with a later-described secondary transfer roller 28 with the intermediate transfer belt 21 interposed therebetween, thus forming a secondary transfer nip region, and is electrically grounded.

The belt cleaner 26 is a member for removing the toner which remains on the image bearing surface after the toner image on the bearing surface of the intermediate transfer belt 21 is transferred onto the recording sheet 8 in the later-described secondary transfer section 4. The belt cleaner 26 is disposed opposite to the supporting roller 25 with the intermediate transfer belt 21 interposed therebetween.

According to the intermediate transfer section 3, the toner images formed on the photoreceptor drums 11*y*, 11*m*, 11*c*, and 11*b*, by a high voltage with a polarity, the reverse of a toner charging polarity, being uniformly applied to the intermediate transfer rollers 22*y*, 22*m*, 22*c*, and 22*b*, are intermediately transferred and overlaid one on another, to a predetermined position of the image bearing surface of the intermediate transfer belt 21, forming a toner image. As will be described hereafter, the toner image is secondarily transferred to the recording paper 8 in a secondary transfer nip region. Toner, paper powder, and the like remaining on the image bearing surface of the intermediate transfer belt 21 after the secondary transfer are removed by the belt cleaner 26, and a multicolor toner image is transferred again to the image bearing surface of the intermediate transfer belt 21.

(Secondary Transfer Section)

The secondary transfer section 4 comprises the supporting roller 24 and a secondary transfer roller 28. The supporting roller 24 has the function of supporting the intermediate transfer belt 24 therearound with tension and additionally has the function of secondarily transferring a multicolor toner image on the intermediate transfer belt 21 to the recording medium 8. The secondary transfer roller 28 is a roller-shaped member which comes into pressure-contact with the supporting roller 24 with the intermediate transfer belt 21 interposed therebetween and is provided so as to be rotation-driven in a direction of an axis line.

The secondary transfer roller 28 comprises, for example, a metal shaft and a conductive layer formed on the surface of the metal shaft. The metal shaft is formed by a metal such as a stainless steel. The conductive layer is formed by a conductive elastomer or the like.

The conductive elastomer can use any conductive elastomer conventionally used in this field, and examples thereof include EPMD, foamed EPDM and foamed urethane, each containing a conductive material such as carbon black. Power source not shown is connected to the secondary transfer roller 28, and high voltage having polarity opposite to the charged polarity of the toner is uniformly applied. The pressure-contact part among the supporting roller 24, the intermediate transfer belt 21 and the secondary transfer roller 28 is a secondary transfer nip region.

According to the secondary transfer section 4, the recording medium 8 sent from a recording medium feeding section 5 described hereinafter is conveyed to the secondary transfer nip region in synchronization with conveying of a toner image on the intermediate transfer belt 21 to the secondary transfer nip region. A multicolored toner image and the recording medium 8 are overlaid in the secondary transfer nip region, and an unfixed toner image is secondarily transferred to the recording medium 8 by uniformly applying high voltage having polarity opposite to the charged polarity of the toner to the secondary transfer roller 28. The recording medium 8 bearing the unfixed toner image is conveyed to the fixing section 6.

(Recording Medium Feeding Section)

The recording medium feeding section 5 comprises a recording paper storage tray 42, a recording paper pickup roller 43, conveying rollers 44*a* and 44*b*, and a conveyance passage P. The recording paper storage tray 42 stores recording mediums 8 which is a recording medium. The recording paper pickup roller 43 picks up the recording medium 8 stored in the recording medium storage tray 42. The conveying rollers 44*a* and 44*b* convey the picked-up recording medium 8 to the secondary transfer section 4.

(Fixing Section)

Figure 3:
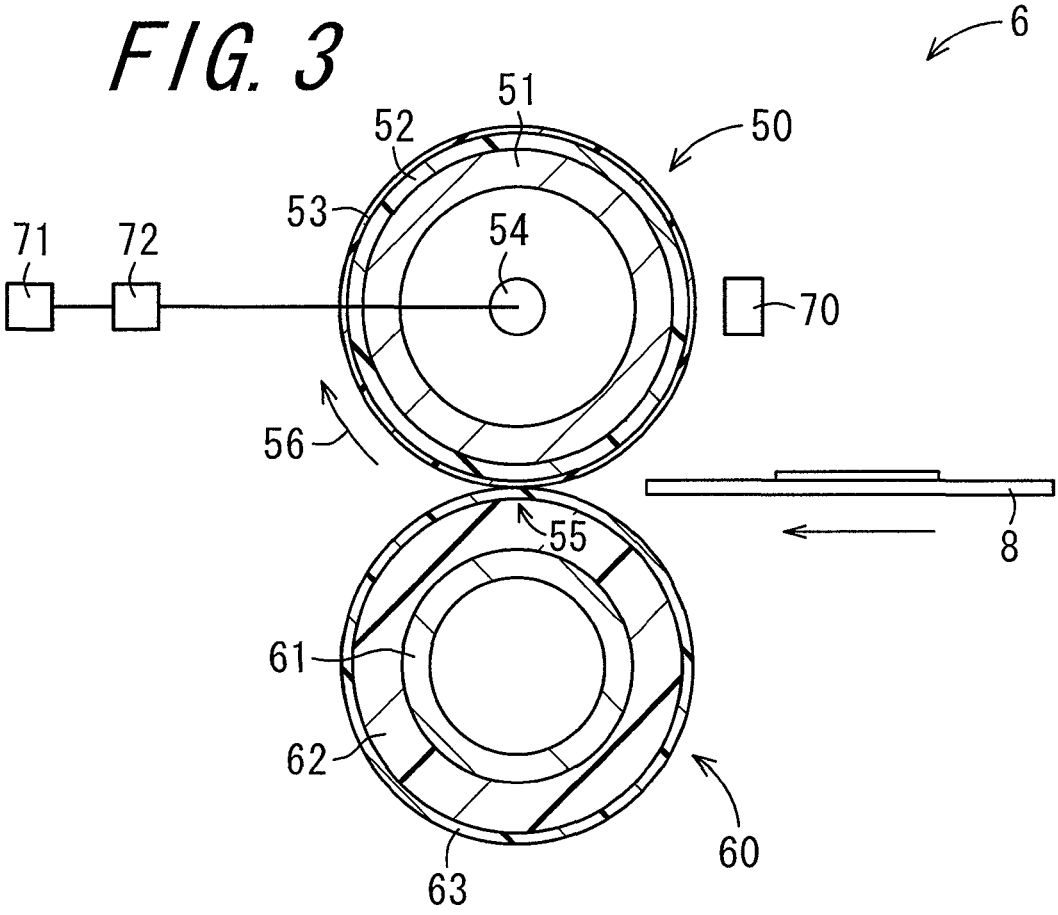
FIG. 3 is a cross-sectional view showing the constitution of a fixing section.

FIG. 3 is a cross-sectional view showing the constitution of the fixing section 6. The fixing section 6 which is a fixing section comprises a fixing roller 50, a pressure roller 60 and a driving section not shown in FIG. 3.

The fixing roller 50 which is a heating section comprises a core metal 51, an elastomer layer 52 and a surface layer 53.

The fixing roller 50 is a roller-shaped member which is rotatably supported by a supporting section not shown and is rotation-driven at a given speed in a direction of an arrow 56 by a fixing roller driving section, and fixes a toner constituting an unfixed toner image borne on the recording medium 8 by fusing the toner under application of heat.

A metal forming the core metal 51 can use a metal having high thermal conductivity, and includes aluminum and iron. The shape of the core metal 51 includes a cylindrical shape and a columnar shape. A cylindrical shape showing small heat discharge from the core metal 51 is preferred. The thickness of the core metal 51 is desirably small for the purpose of decreasing heat capacity of the fixing roller 50. The thickness of 0.4 mm or more and 1.0 mm or less makes it possible to shorten warming-up time and further to prevent poor fixing at the central portion of the recording medium 8 due to deflection of the fixing roller 50.

The elastomer layer 52 is a layer formed on the outer peripheral surface of the core metal 51. The material constituting the elastomer layer 52 is not particularly limited so long as it has rubber elasticity. However, the material further having excellent heat resistance is preferred. Examples of the material include a silicone rubber, a fluorine rubber and a fluorosilicone rubber. Of those, a silicone rubber having excellent rubber elasticity is particularly preferred. The thickness of the elastomer layer 52 is desirably small from the standpoint of heat capacity, and the thickness of 0.5 mm or less is most preferred. The elastomer layer 52 may not be provided.

The surface, layer 53 is a layer formed on the outer peripheral surface of the elastomer layer 52. The material constituting the elastomer layer 53 is not particularly limited so long as it has excellent heat resistance and durability and has weak adhesive force to a toner. Examples of the material include fluorine resin materials such as PFA (a copolymer of tetrafluoroethylene and perfluoroalkyl vinyl ether) and PTFE (polytetrafluoroethylene), and fluorine rubbers. The thickness of the surface layer 53 is preferably 5 μm or more and 50 μm or less.

A heat source 54 is provided inside the fixing roller 50. Specifically, the heat source 54 is provided in an inner space formed inward in a radial direction of the cylindrically shaped core metal 51, and generates heat by current conduction. In the present embodiment, the heat source 54 uses a halogen lamp.

In the fixing roller 50, heat generated in the heat source 54 transfers to the core metal 51, the elastomer layer 52 and the surface layer 53 in this order. By the heat, there is heated an unfixed toner image borne on the recording medium 8 coming into contact with the surface of the fixing roller 50, that is, the outer peripheral surface of the surface layer 53. The heat generated in the heat source 54 is stored inside the fixing roller 50 although a part of the heat is released from the surface of the fixing roller 50.

The pressure roller 60 which is a pressure section comprises a core metal 61, an elastomer layer 62 and a surface layer 63. The pressure roller 60 is a roller-shaped member which is rotatably provided in the state where it comes into pressure-contact with the fixing roller 50 by a pressure mechanism not shown at a downstream side in a rotation direction of the fixing roller 50 with respect to the lowest point in a vertical direction of the fixing roller 50. The pressure-contact part between the fixing roller 50 and the pressure roller 60 is a fixing nip region 55. The pressure roller 60 rotates according to the rotation of the fixing roller 50. In heat fixing a toner image to the recording medium 8 by the fixing roller 50, the pressure roller 60 presses a toner in a fused state against the recording medium 8, thereby promoting fixing of the toner image to the recording medium 8.

Materials forming the core metal 61, the elastomer layer 62 and the surface layer 63 of the pressure roller 60 can use the same metals or materials forming the core metal 51, the elastomer layer 52 and the surface layer 53 of the fixing roller 50, respectively. In the present embodiment, the pressure roller 60 has a diameter of 40 mm.

As shown in FIG. 3, the image forming apparatus 1 further comprises a voltage detection section 72, a temperature detection section 70 and a control section 9 (referring to FIG. 4) which controls an image formation operation described hereinafter. The temperature detection section 70 is provided in the vicinity of the surface of the fixing roller 50, and detects the surface temperature of the fixing roller 50. The voltage detection section 72 detects voltage applied to the fixing section 6 from a power source 71.

Figure 4:
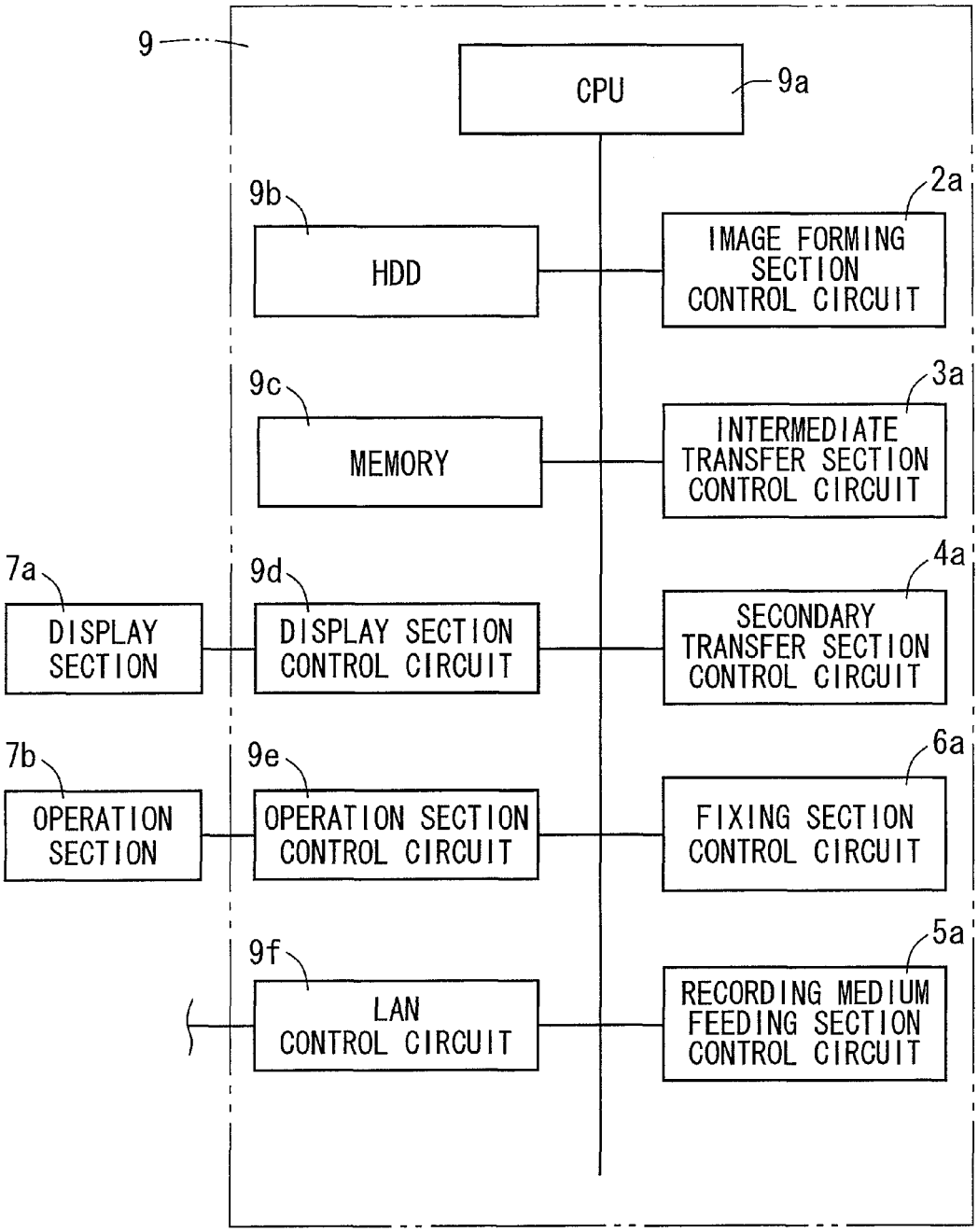
FIG. 4 is a block diagram showing the constitution of a control section of the image forming apparatus.

FIG. 4 is a block diagram showing the constitution of the control section 9 of the image forming apparatus 1. The control section 9 comprises CPU (Central Processing Unit) 9*a*, HDD (Hard Disk Drive) 9*b*, a memory 9*c*, a display section control circuit 9*d*, an operation section control circuit 9*e*, LAN (Local Area Network) control circuit 9*f*, an image forming section control circuit 2*a*, an intermediate transfer section control circuit 3*a*, a secondary transfer section control circuit 4*a*, a recording medium feeding section control circuit 5*a* and a fixing section control circuit 6*a*.

Software such as OS (Operation System) used to control the image forming apparatus 1 and various control programs and application programs are memorized in the HDD 9*b*. The CPU 9*a* comprises microprocessors, and performs various controls and processing based on the software memorized in the HDD 9*a*.

The display section control circuit 9*d* controls the operation of a display section 7*a* formed by LCD (Liquid Crystal Display). The operation section control circuit 9*e* controls the operation of an operation section 7*b* equipped with various keys. The LAN control circuit 9*f* controls the operation of LAN interface. The image forming section control circuit 2*a* controls the operation of the image forming section 2. The intermediate transfer section control circuit 3*a* controls the operation of the intermediate transfer section 3. The secondary transfer section control circuit 4*a* controls the operation of the secondary transfer section 4. The recording medium feeding section control circuit 5*a* controls the operation of the recording medium feeding section 5. The fixing section control circuit 6*a* which is a fixing control section controls the operation of the fixing section 6.

Figure 5:
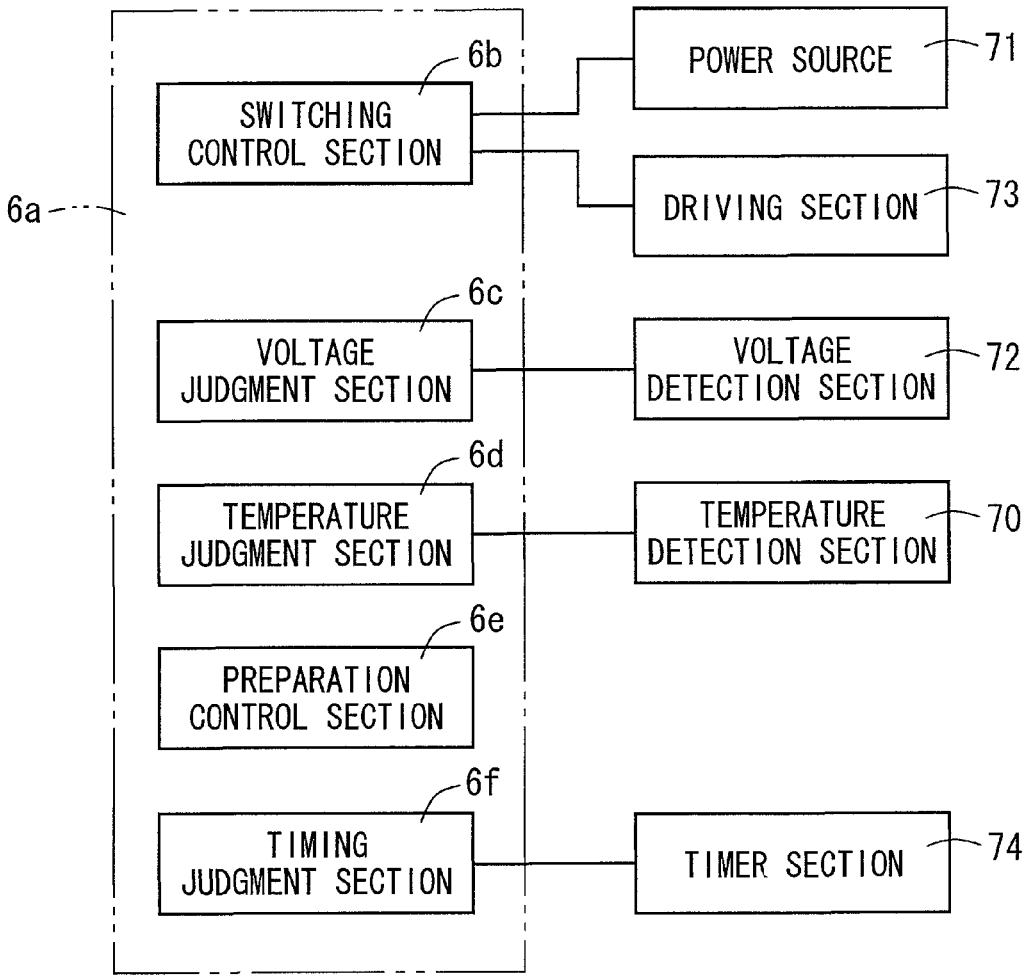
FIG. 5 is a block diagram showing the constitution of a fixing section control circuit.

FIG. 5 is a block diagram showing the constitution of the fixing section control circuit 6*a*.

The fixing section control circuit 6*a* comprises a switching control section 6*b*, a voltage judgment section 6*c*, a temperature judgment section 6*d*, a preparation control section 6*e*, and a timing judgment section 6*f*.

The switching control section 6*b* controls the switching operation of on conduction and off conduction between a heat source 54 and a power source 71, and between a driving section 73 rotation-driving the fixing roller 50 and the power source 71.

The voltage judgment section 6*c* judges as to whether or not the detected voltage by a voltage detection section 72 is a given threshold voltage or more.

The temperature judgment section 6*d* judges as to whether or not the detected temperature by a temperature detection section 70 is a given preset temperature or higher.

The preparation control section 6*e* controls the preparation operation of the fixing roller 50 before performing the image forming operation of forming a toner image on the photoreceptor drum 11 by the image forming section 2.

The timing judgment section 6*f* judges as to whether or not the measured time by a timer section 74 provided in the image forming apparatus 1 is a given time or more.

The image forming operation of the image forming apparatus 1 is described below by reference to FIGS. 6A, 6B and 7.

Figure 6A:
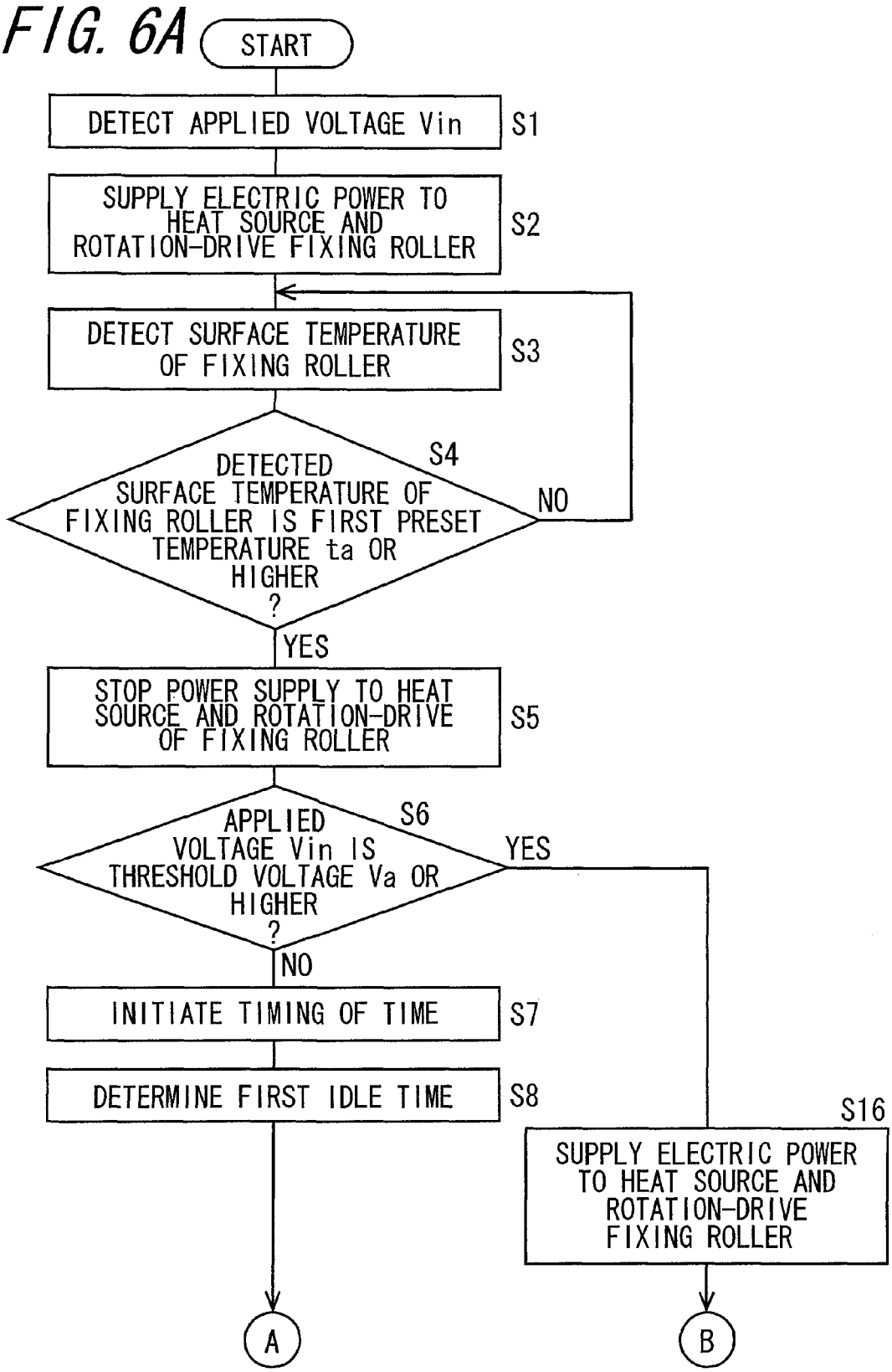
FIGS. 6A and 6B are flow charts showing the operation of the image forming apparatus.
Figure 6B:
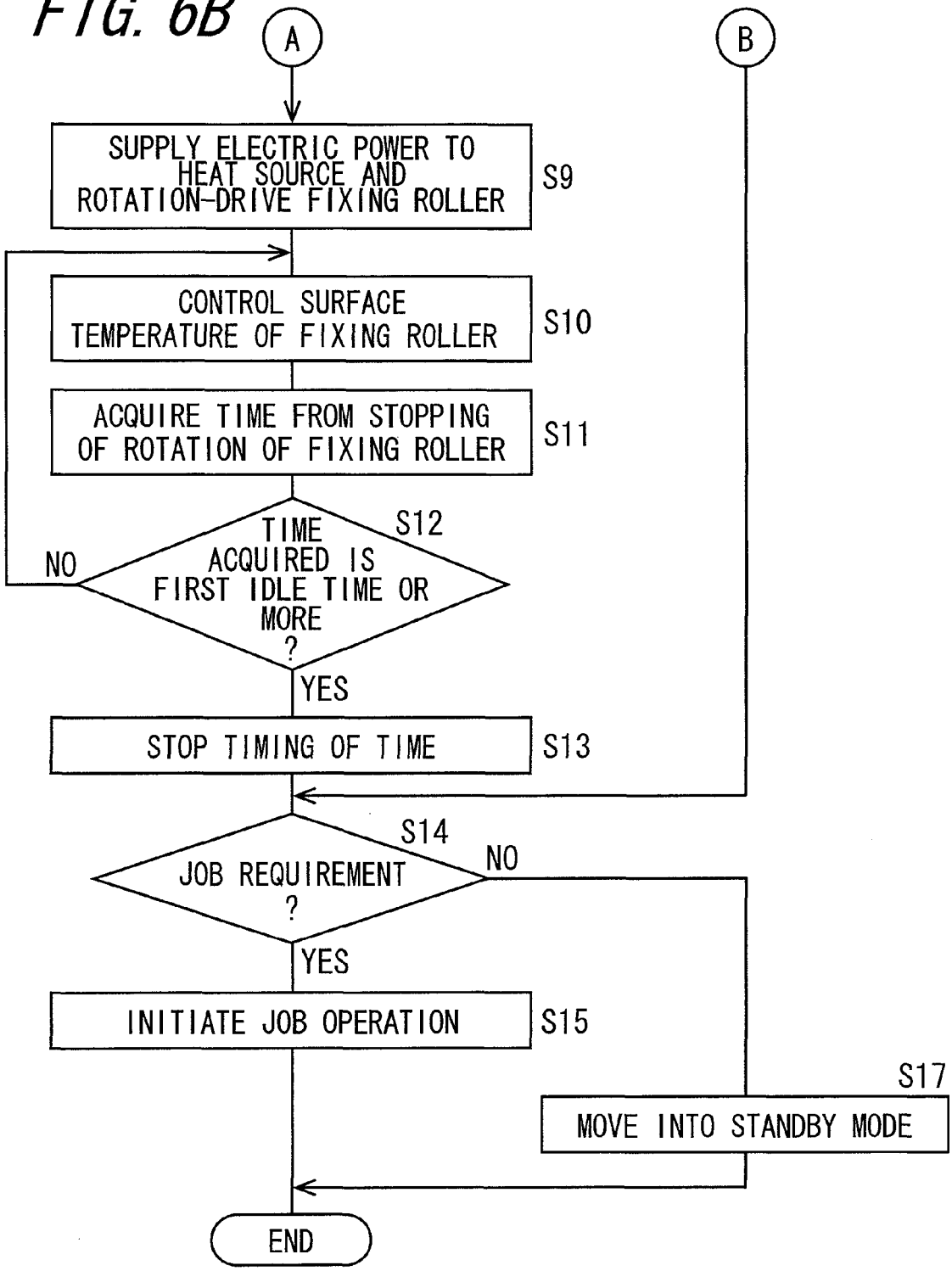
Figure 7:
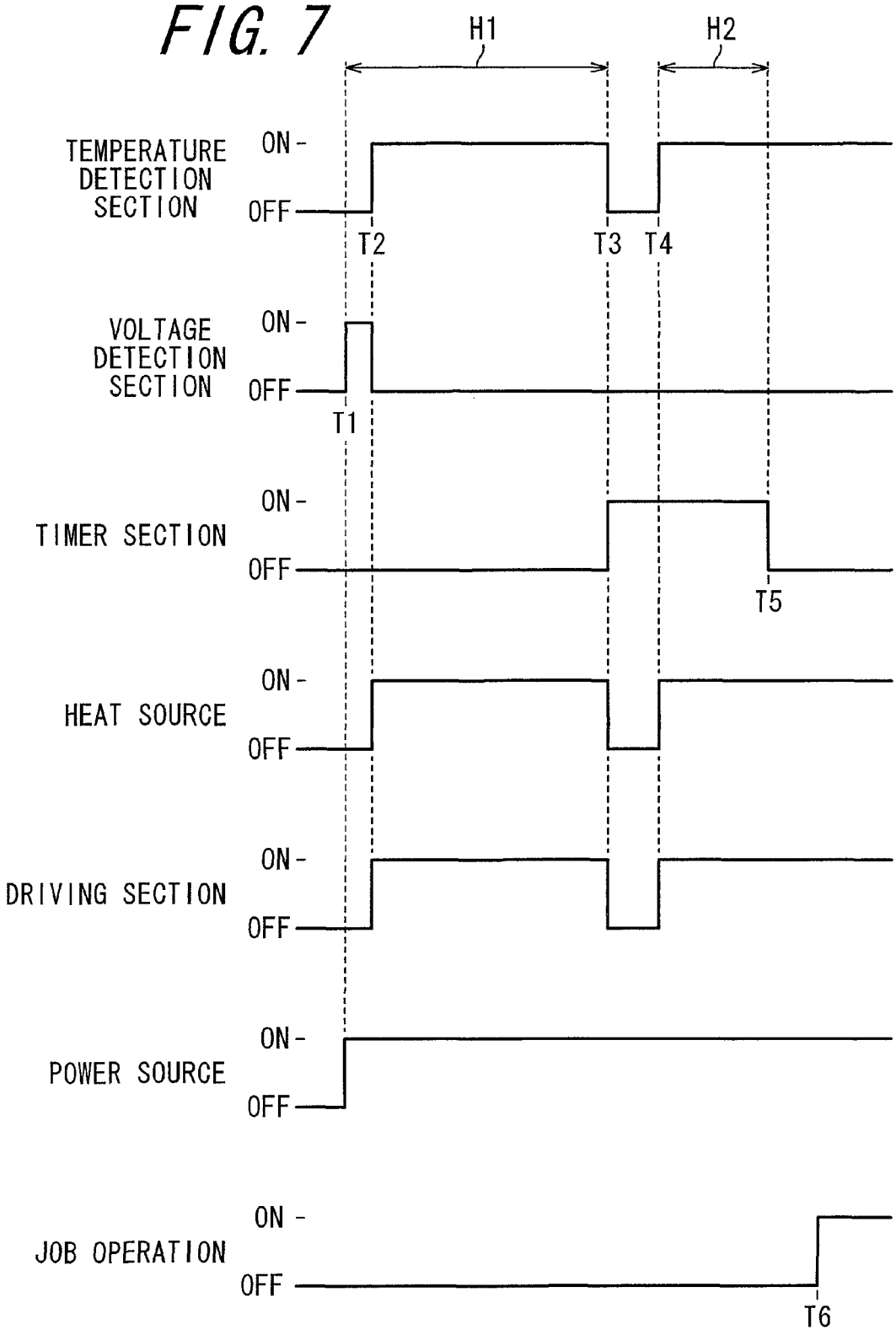
FIG. 7 is a timing chart showing timing of the operation in the image forming apparatus.

FIGS. 6A and 6B are flow charts showing the operation of the image forming apparatus 1. FIG. 7 is a timing chart showing timing of the operation in the image forming apparatus 1. In the image forming apparatus 1, when the CPU 9*a* detects power activation signal to the power source 71 or return signal from a sleep mode (time T1), the procedure proceeds to step S1 and an image forming operation in the image forming apparatus 1 is initiated.

In step S1, the voltage detection section 72 detects applied voltage Vin applied to the fixing section 6 from the power source 71 at the time T1.

In step S2, the switching control section 6*b* sends control signal to the power source 71 which supplies electric power to the heat source 54 provided inside the fixing roller 50, switches a conduction state between the power source 71 and the heat source 54 from an off conduction state to an on conduction state, and supplies electric power to the heat source 54 at time T2. At the same time, the switching control section 6*b* switches the conduction state between the power source 71 and a driving section 73 from the off conduction state to the on conduction state, and rotation-drives the fixing roller 50 in a direction of an arrow 56 at the time T2. By this, the fixing roller 50 is heated, and the pressure roller 60 is drivenly rotated according to the driving of the fixing roller 50.

In step S3, the temperature detection section 70 detects the surface temperature of the fixing roller 50 at the time T2.

In step 4, the temperature judgment section 6*d* judges as to whether or not the surface temperature of the fixing roller 50 detected in step S3 is a first preset temperature ta or higher. When the surface temperature is lower than the first preset temperature ta, the procedure returns to step S3, and this operation is repeated until the surface temperature of the fixing roller 50 reaches the first preset temperature ta or higher. When the surface temperature is the first preset temperature ta or higher, the procedure proceeds to step S5. The first preset temperature ta is, for example, 200° C.

The time point (time T3) that the CPU 9*a* has detected that the surface temperature of the fixing roller 50 reaches the first preset temperature ta or higher is the completion of a warming-up period H1. The temperature detection section 70 stops the detection of the surface temperature of the fixing roller 50 at the time T3.

In step S5, the preparation control section 6*e* controls the switching control section 6*b*, and switches the conduction state to the heat source 54 from the on conduction state to the off conduction state, thereby stopping power supply to the heat source 54 at the time T3. Additionally, the preparation control section 6*e* controls the switching control section 6*b*, and switches the conduction state to the driving section 73 from the on conduction state to the off conduction state, thereby stopping rotation-driving of the fixing roller 50 at the time T3.

In step S6, the voltage judgment section 6*c* makes a comparison between the applied voltage Vin and a give threshold voltage Va, and judges at the time T3 as to whether or not the applied voltage Vin is the threshold voltage Va or higher. When the applied voltage Vin is the threshold voltage Va or higher, the procedure proceeds to step S16. When the applied voltage Vin is lower than the threshold voltage Va, the procedure proceeds to step S7. The embodiment that the applied voltage Vin is lower than the threshold voltage Va shows that power supply to the heat source 54 is not sufficient. In the present embodiment, the threshold voltage Va is 205V.

In step S7, the timer section 74 initiates the time measurement at the time T3.

Hereafter, it transfers to a preparation operation period H2 that the preparation control section 6*e* controls the preparation operation of the fixing roller 50.

In step S8, the preparation control section 6*e* determines a first idle time using the first table. The first table correlates an idle time and a voltage value, and correlates such that the idle time is shortened with increasing the value of the applied voltage Vin. The first table is memorized in the memory 9*c*. By this, the preparation control section 6*e* can determine the idle time according to the applied voltage Vin. An example of the first table is shown in Table 1.

TABLE 1

| Applied voltage Vin (V) | First idle time (sec) |
|---|---|
| (Rated voltage × 0.95) or more | 0 |
| (Rated voltage × 0.92) or more and less than (rated voltage × 0.95) | 25 |
| Less than (rated voltage × 0.92) | 50 |

Quantity of heat stored in the fixing roller 50 is increased with increasing the voltage applied to the fixing section 6 from the power source 71, and quantity of heat stored in the fixing roller 50 is decreased with decreasing the voltage applied to the fixing section 6 from the power source 71. For this reason, as shown in Table 1, the first idle time is relatively short with increasing the voltage applied to the fixing section 6 from the power source 71, and the first idle time is required to be relatively long with decreasing the voltage applied to the fixing section 6 from the power source 71.

Since the preparation control section 6*e* determines the first idle time using the first table correlating the idle time and the voltage value such that the idle time becomes short with increasing the voltage value, the optimum first idle time can be determined based on the voltage applied to the fixing section 6 from the power source 71. As a result, storage of heat of the fixing roller 50 can sufficiently be secured in the stable manner, occurrence of poor fixing can be prevented, and additionally, higher speed printing can be realized.

In step S9, the preparation control section 6*e* controls the switching control section 6*b* and switches the conduction state between the power source 71 and the heat source 54 from the off conduction state to the on conduction state, thereby supplying electric power to the heat source 54 at time T4. Additionally, the preparation control section 6*e* controls the switching control section 6*b* and switches the conduction state to the driving section 73 from the off conduction state to the on conduction state, thereby rotation-driving the fixing roller 50 at the time T4.

In step S10, control of the surface temperature of the fixing roller 50 is performed in the state of rotation-driving the fixing roller 50. The control of the surface temperature of the fixing roller 50 is performed by controlling the switching control section 6*b* by the preparation control section 6*e* and appropriately switching the conduction state between the power source 71 and the heat source 54 (ON/OFF control). In the present embodiment, the surface temperature of the fixing roller 50 is maintained at 200° C.

In step S11, the timing judgment section 6*f* acquires elapsed time from the time T3.

In step S12, the timing judgment section 6*f* judges as to whether or not the time acquired in step S11 is the first idle time or more determined in step S8. When the time obtained is less than the first idle time, the procedure returns to step S10, and this operation is repeated until the time obtained reaches the first idle time or more while controlling the surface temperature of the fixing roller 50. When the time obtained is the first idle time or more, the procedure proceeds to step S13. By rotation-driving the fixing roller 50 over the first idle time in the state that the surface temperature of the fixing roller 50 is maintained at a constant temperature, sufficient heat is supplied to the core metal 51 from the heat source 54, and storage of heat of the core metal 51 becomes sufficient.

In step S13, the timer section 74 stops the time measurement at time T5.

As described above, in the preparation operation period H2 before initiation of the image forming operation and after completion of the warming-up operation, when the voltage judgment section 6*c* has judged that the applied voltage Vin by the voltage detection section 72 is less than the threshold voltage Va, the preparation control section 6*e* controls the preparation operation such that the switching control section 6*b* continues the on conduction state to the heat source 54 and the driving section 73 over the first idle time. Therefore, the voltage applied to the fixing section 6 is low, even though the current conduction to the heat source 54 is insufficient, storage of heat of the fixing roller 50 can sufficiently be secured before the image forming operation by the image forming section 2 is performed, that is, before initiation of the image forming operation, and occurrence of poor fixing can be prevented. Furthermore, storage of heat of the fixing roller 50 is sufficiently secured. Therefore, even though a large amount of recording medium 8 is continuously conveyed to the fixing nip region 55 at the time of fixing and heat of the fixing roller 50 is absorbed by the recording medium 8, lowering of the surface temperature of the fixing roller 50 can be suppressed utilizing storage of heat. For this reason, time interval that the recording medium 8 is conveyed to the fixing nip region 55 can be shortened, or conveying speed of the recording medium 8 can be increased, thereby high speed printing can be realized.

In step S14, the CPU 9*a* judges as to whether there is job requirement. When there is job requirement, the procedure proceeds to step S15, and when there is no job requirement, the procedure proceeds to step S17.

In step S15, the CPU 9*a* initiates job operation at time T6.

In step S17, the CPU 9*a* transfers the mode to a standby mode.

When the procedure proceeds from step S6 to step S16, in step S16, the preparation control section 6*e* controls the switching control section 6*b*, and switches a conduction state to the heat source 54 from the off conduction state to the on conduction state, thereby supplying electric power to the heat source 54. The preparation control section 6*e* controls the switching control section 6*b* and switches the conduction state to the driving section 73 from the off conduction state to the on conduction state, thereby rotation-driving the fixing roller 50. Thereafter, the procedure proceeds to step S14.

In the operation of the image forming apparatus 1, the first idle time is determined using the first table. However, the first idle time may previously be determined to a given time.

Figure 8A:
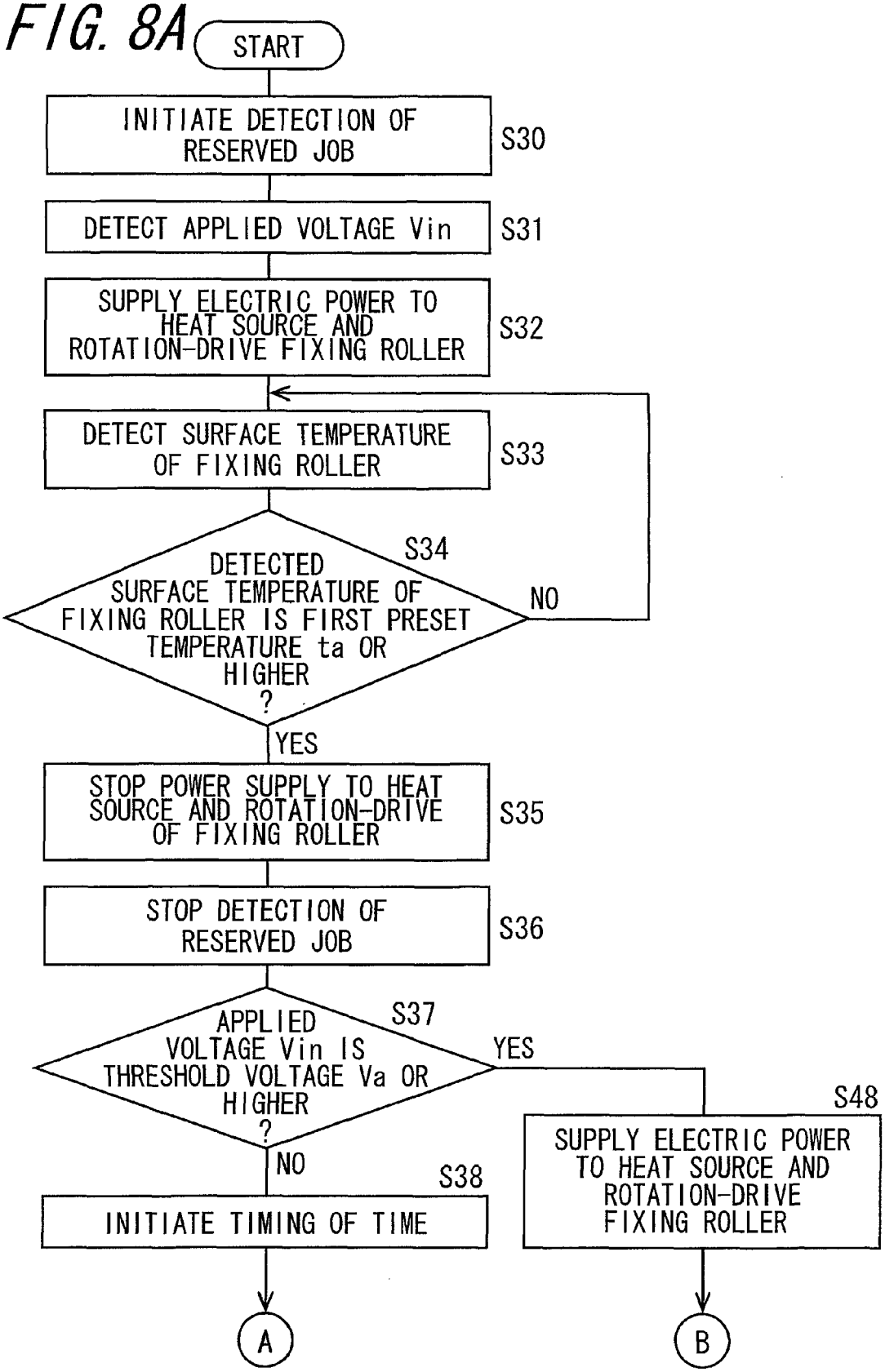
FIGS. 8A and 8B are flow charts showing the operation of the image forming apparatus.
Figure 8B:
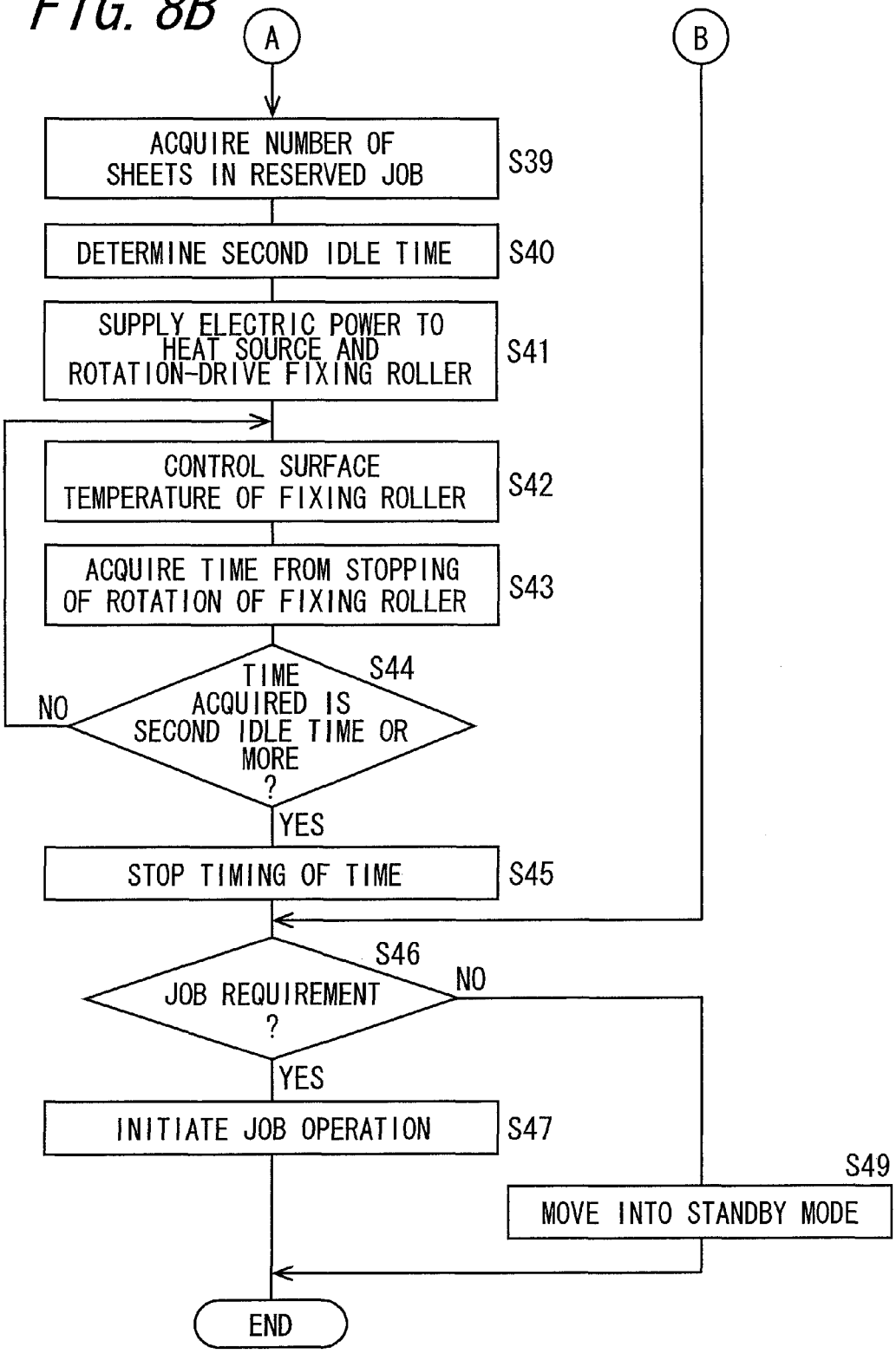
Figure 9:
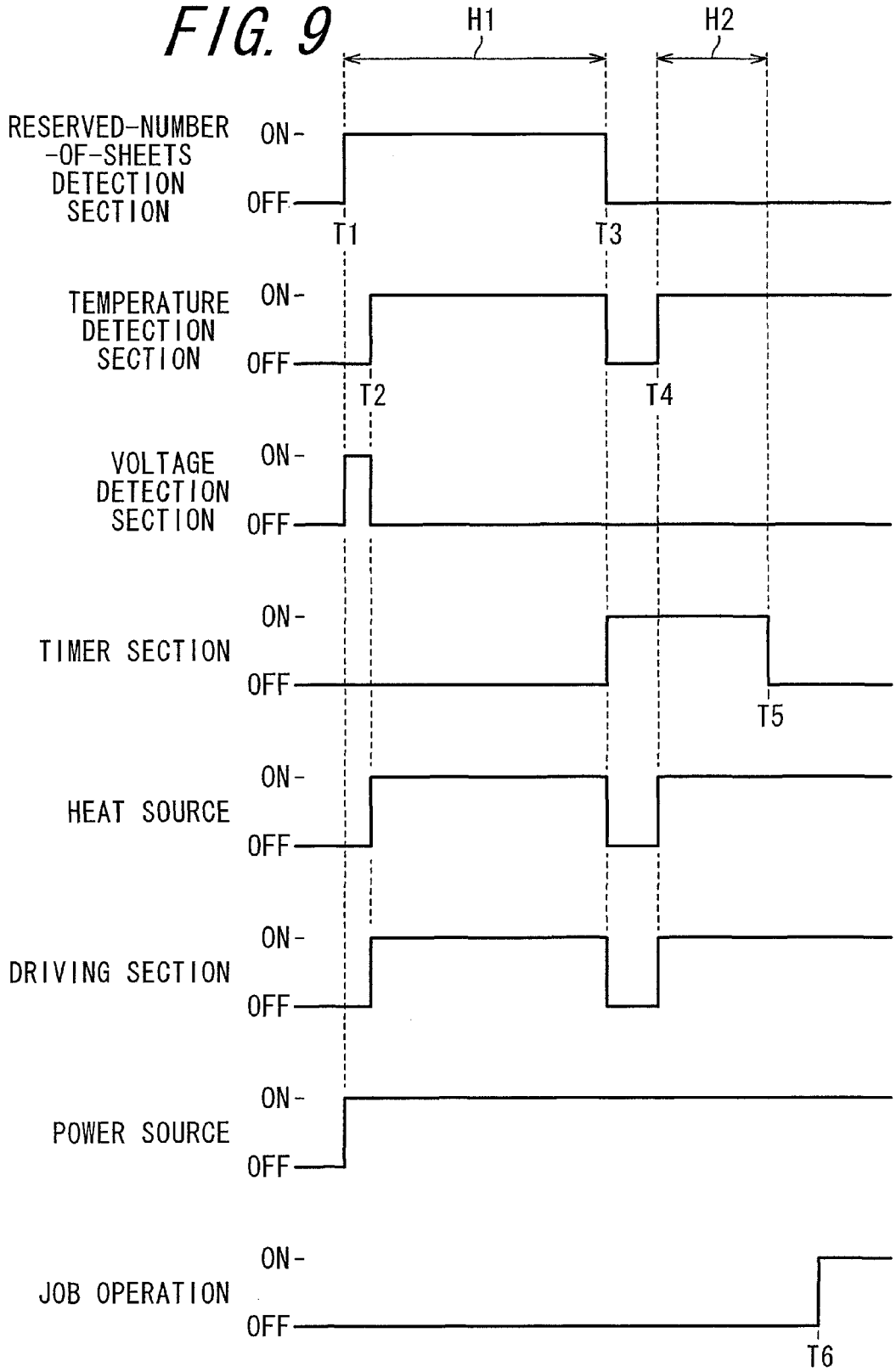
FIG. 9 is a timing chart showing the timing of operation in the image forming apparatus.

FIGS. 8A and 8B are flow charts showing the operation of the image forming apparatus 1. FIG. 9 is a timing chart showing the timing of operation in the image forming apparatus 1. In the image forming apparatus 1, at the time point that the CPU 9*a* has detected power activation signal to the power source 71 or return signal from a sleep mode (the time T1), the procedure proceeds to step S30, and image forming operation in the image forming apparatus 1 is initiated.

In step S30, the operation section control circuit 9*e* shown in FIG. 4 plays a role of a reserved-number-of-sheets detection section, and the reserved-number-of-sheets detection section initiates detection of the number of reserved job corresponding to the reserved number of sheets of the recording medium 8 forming an image at the time T1. Specifically, the reserved-number-of-sheets detection section detects the number of reserved job corresponding to the reserved number of sheets of the recording medium 8 forming an image, which is inputted from the operation section 7*b*.

In step S31, the voltage detection section 72 detects the applied voltage Vin applied to the fixing section 6 from the power source 71 at the time T1, similarly to step S1 of the flow charts shown in FIGS. 6A and 6B.

Steps S32 to S35 are the same as steps S2 to S5 of the flow charts shown in FIGS. 6A and 6B.

In step S36, the reserved-number-of-sheets detection section stops the detection of the reserved job number at the time T3.

Steps S37 and S38 are the same as steps S6 and S7 of the flow charts shown in FIGS. 6A and 6B.

In step S39, the preparation control section 6*e* acquires the number of sheets in reserved job reserved during the warming-up period H1, detected by the reserved number detection section.

In step S40, the preparation control section 6*e* determines the second idle time using the second table. The second table correlates an idle time, the number of reserved job and a voltage value, and those are correlated such that the idle time becomes short with increasing the voltage value and decreasing the number of reserved job. By the correlation, the preparation control section 6*e* can determine a second idle time according to the voltage applied to the fixing section 6 from the power source 71 and the number of reserved job. The second table is memorized in a memory 9*c*. Example of the second table is shown in Table 2.

TABLE 2

| | Second idle time (sec) Number of reserved jobs | | |
|---|---|---|---|
| | 0 to 5 | 6 to 30 | 31 or more |
| (Rated voltage × 0.95) or more | 0 | 0 | 0 |
| (Rated voltage × 0.92) or more and less than (rated voltage × 0.95) | 0 | 10 | 25 |
| Less than (rated voltage × 0.92) | 0 | 25 | 50 |

Quantity of heat stored in the fixing roller 50 just after completion of the warming-up period H1 is increased with increasing the voltage applied to the fixing section 6 from the power source 71, and quantity of heat stored in the fixing roller 50 just after completion of the warming-up period H1 is decreased with decreasing the voltage applied to the fixing section 6 from the power source 71. In other words, the second idle time is relatively short with increasing the voltage applied to the fixing section 6 from the power source 71, and the second idle time is required to be relatively long with decreasing the voltage applied to the fixing section 6 from the power source 71.

Furthermore, large quantity of heat on the surface of the fixing roller 50 is absorbed by the recording medium 8 passing through the fixing nip section 55 at the time fixing operation with increasing the reserved number of sheets of the recording medium 8 forming an image, and the surface temperature of the fixing roller 50 is liable to be decreased. Furthermore, quantity of heat on the surface of the fixing roller 50 absorbed by the recording medium 8 passing through the fixing nip section 55 at the time fixing operation is decreased with decreasing the reserved number of sheets of the recording medium 8 forming an image. Therefore, the surface temperature of the fixing roller 50 is difficult to be decreased. In other words, the second idle time is required to be relatively long with increasing the reserved number of sheets of the recording medium 8, and the second idle time can be relatively short with decreasing the reserved number of sheets of the recording medium 8.

The preparation control section 6*e* determines the second idle time using the second table correlating the idle time, the number of reserved job and the voltage value such that the idle time becomes short with increasing the voltage value and decreasing the number of reserved job. This can determine the optimum second idle time based on the voltage applied to the fixing section 6 from the power source 71 and the number of reserved job. As a result, storage of heat of the fixing roller 50 can sufficiently be secured in a stable manner, occurrence of poor fixing can be prevented, and additionally, higher speed printing can be realized.

Steps S41 to S43 are the same as steps S9 to S11 of the flow chart shown in FIG. 6B.

In step S44, the timing judgment section 6*f* judges as to whether or not the time acquired in step S43 is the second idle time or more determined in step S40. When the time is less than the second idle time, the procedure returns to step S42, and this operation is repeated until the time reaches the second idle time or more. When the time is the second idle time or more, the procedure proceeds to step S45. By rotation-driving the fixing roller 50 over the first idle time in the state that the heat source 54 generates heat by the current conduction, sufficient heat is supplied to the core metal 51 from the heat source 54, and storage of heat of the core metal 51 of the fixing roller 50 becomes sufficient.

Steps S45 to S49 are the same as steps S13 and S17 of the flow charts shown in FIGS. 6A and 6B.

As described above, in the preparation operation period H2 before initiation of the image forming operation and after completion of the warming-up operation, when the voltage judgment section 6*c* has judged that the applied voltage Vin by the voltage detection section 72 is less than the threshold voltage Va, the preparation control section 6*e* controls the preparation operation such that the switching control section 6*b* continues the on conduction state to the heat source 54 and the driving section 73 over the second idle time. Therefore, even though the voltage applied to the fixing section 6 is low and the current conduction to the heat source 54 is insufficient, the storage of heat of the fixing roller 50 can sufficiently be secured before performing the image forming operation by the image forming section 2, that is, before initiation of the image forming operation, and occurrence of poor fixing can be prevented. Furthermore, because the storage of heat of the fixing roller 50 is sufficiently secured, even though a large amount of the recording medium 8 is continuously conveyed to the fixing nip region 55 at the time of fixing and heat of the fixing roller 50 is absorbed by the recording medium 8, lowering of the temperature of the fixing roller 50 can be suppressed utilizing the heat storage. For this reason, the time interval that the recording medium 8 is conveyed to the fixing nip region 55 can be shortened or the conveying speed of the recording medium 8 can be increased, thereby high speed printing can be realized.

EXAMPLES

Example 1

An image forming apparatus (product name: MX-M700, manufactured by Sharp Corporation) in which rated voltage of a power source is 230V was used. After CPU detected a power activation signal to the power source, the operations of the flow charts shown in FIGS. 6A and 6B were conducted. Processing speed of this image forming apparatus is 395 mm/sec, and 75 sheets can be printed per minute.

In a fixing section, a fixing roller having a diameter of 40 mm, in which a core metal has a thickness of 0.8 mm, an elastomer layer has a thickness of 200 μm and a surface layer has a thickness of 40 μm was used. Furthermore, a pressure roller having a diameter of 40 mm, in which a core metal has a thickness of 3 mm, an elastomer layer has a thickness of 5 mm and a surface layer has a thickness of 0.05 mm was used. The total load applied to a fixing nip region was adjusted to 70 kg. A first idle time was set to 50 seconds, a threshold voltage Va was set to 212V, and a voltage applied to the fixing section by an alternating current stabilized power supply was set to 207V. After completion of a preparation operation period, a continuous job of 100 sheets was conducted.

Example 2

A job was conducted in the same manner as in Example 1, except that after 1 hour has passed since transfer to a sleep mode and CPU detected a return signal from the sleep mode, the operations of the flow charts shown in FIGS. 6A and 6B were conducted.

Example 3

A job was conducted in the same manner as in Example 1, except that the first idle time was determined using the first table shown in Table 1 above.

Example 4

A job was conducted in the same manner as in Example 3, except that the voltage applied to the fixing section was changed from 207V to 218V.

Examples 5 to 10

The image forming apparatus used in Example 1 was used, and the second table shown in Table 2 above was used. After CPU detected a power activation signal to a power source, the operations of the flow charts shown in FIGS. 8A and 8B were conducted. The voltage applied to the fixing section and the number of reserved jobs are shown in Table 3 below.

Comparative Example 1

A job was conducted in the same manner as in Example 1, except that a preparation operation period was not provided just after completion of the warming-up.

<Evaluation>

Using the output images obtained in Examples 1 to 10 and Comparative Example 1, fixability of a black solid portion was evaluated by the following rubbing test.

The rubbing test was conducted as follows. A sand-containing eraser to which 9.8N-load was applied by a weight was pressed to a black solid portion of an output image. Reflected density before and after reciprocating the sand-containing eraser three times was measured with Model 938, manufactured by X-Rite, and the proportion of change of the reflected density was quantified.

When fixing strength obtained by quantifying the proportion of change of the reflected density is 70 or more, it can be judged that sufficient fixability was obtained.

The evaluation results of Examples 1 to 4 and Comparative Example 1 are shown in Table 3, and the evaluation results of Examples 5 to 10 are shown in Table 4.

TABLE 3

| | Applied voltage Vin (V) | The number of reserved jobs (Sheets) | Idle time (sec) | Fixing strength |
|---|---|---|---|---|
| Example 1 | 207 | — | 50 | 74.2 |
| Example 2 | 207 | — | 50 | 74.8 |
| Example 3 | 207 | — | 50 | 74.2 |
| Example 4 | 218 | — | 25 | 74.5 |
| Comparative Example 1 | 207 | — | — | 68.4 |

TABLE 4

| | Applied voltage Vin (V) | The number of reserved jobs (sheets) | Idle time (sec) | Fixing strength | Output time (sec) |
|---|---|---|---|---|---|
| Example 5 | 230 | 100 | 0 | 75.8 | 44.7 |
| Example 6 | 219 | 5 | 0 | 85.9 | 50 |
| Example 7 | 219 | 100 | 25 | 74.2 | 75.8 |
| Example 8 | 207 | 5 | 0 | 81.0 | 55.2 |
| Example 9 | 207 | 30 | 25 | 78.6 | 79.8 |
| Example 10 | 207 | 100 | 50 | 74.2 | 106.1 |

It is seen that sufficient fixability was obtained in Examples 1 to 10. Furthermore, as in Examples 5 to 10, when the control is conducted based on the applied voltage and the number of reserved jobs, the idle time can be shorted in the case that the number of reserved jobs is small, the period of from power activation of the image forming apparatus to the output of an image can further be shortened, and additionally, sufficient fixability can be obtained.

In Comparative Example 1, when rubbing with fingers a little strongly, the toner on the black solid portion flows, and sufficient fixability could not be obtained.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus in which a toner image is formed by feeding a toner to an electrostatic latent image formed on an image bearing member by electrophotography, by a developing device, the apparatus comprising:

a transfer section which transfers the toner image borne on the image bearing member to a recording medium;

a fixing section which heats the image toner transferred to the recording medium to fix the image toner to the recording medium, the fixing section comprising a heating section having a heat source for generating heat by current conduction provided therein, and arranged so as to be rotation-driven around an axis thereof, a pressure section provided so as to form a pressure-contact part between the pressure section and the heating section by coming into pressure-contact with the heating section, and a driving section which rotates the heating section by current conduction;

a power source which applies a voltage to the fixing section;

a voltage detection section which detects a voltage applied to the fixing section from the power source;

a temperature detection section which detects a temperature of a surface of the heating section;

a fixing control section which controls the operation of the fixing section, the fixing control section comprising:

a switching control section which controls switching on and off conduction operations between the heat source and the power source, and between the driving section and the power source;

a voltage judgment section which judges as to whether or not a detected voltage by the voltage detection section is a given threshold voltage or more;

a temperature judgment section which judges as to whether or not a detected temperature by the temperature detection section is a given preset temperature or higher; and a preparation control section which controls a preparation operation of the heating section before performing the operation of forming a toner image on the image bearing member, wherein when the switching control section switches a conduction state to the heat source and the driving section from an off conduction state to an on conduction state and the voltage judgment section judges that the detected voltage by the voltage detection section is less than the threshold voltage, the preparation control section controls the preparation operation of the heating section such that the switching control section continues the on conduction state over a given idle time after the temperature judgment section has judged that the detected temperature by the temperature detection section is a preset temperature or higher; and a memory section which memorizes a first table linking the idle time and a voltage value, wherein the preparation control section determines the idle time using the first table.

2. The image forming apparatus of claim 1, wherein when voltage is applied to the fixing section from the power source or when return operation from a sleep mode is initiated, the preparation control section controls the preparation operation of the heating section.

3. The image forming apparatus of claim 1, comprising a reserved job number detection section which detects a number of reserved jobs corresponding to a reserved number of sheets of recording mediums on which an image is formed, the memory section memorizes a second table linking the idle time, the number of reserved jobs and a voltage value, and the preparation control section determines the idle time using the second table.

* * * * *